United States Patent [19]

von der Eltz et al.

[11] 4,297,101

[45] Oct. 27, 1981

[54] PROCESS FOR THE DYEING OF SYNTHETIC POLYAMIDE FIBERS WITH REACTIVE DYES ACCORDING TO THE BATCHWISE EXHAUSTION METHOD

[75] Inventors: Hans-Ulrich von der Eltz, Frankfurt am Main; Armand Lehinant, Offenbach; Joachim W. Lehmann, Kelkheim; Hans-Peter Maier, Sulzbach, all of Fed. Rep. of Germany

[73] Assignee: Hoechst Aktiengesellschaft, Frankfurt am Main, Fed. Rep. of Germany

[21] Appl. No.: 159,443

[22] Filed: Jun. 13, 1980

Related U.S. Application Data

[63] Continuation of Ser. No. 64,775, Aug. 8, 1979, abandoned.

[30] Foreign Application Priority Data

Aug. 10, 1978 [DE] Fed. Rep. of Germany ..... 2834997

[51] Int. Cl.[3] ..... D06P 3/82

[52] U.S. Cl. ..... 8/531; 8/543; 8/924

[58] Field of Search ..... 8/531, 543, 924

[56] References Cited

U.S. PATENT DOCUMENTS

| | | | |
|---|---|---|---|
| 3,767,356 | 10/1973 | Turner | 8/400 |
| 4,063,877 | 12/1977 | Elliot et al. | 8/543 |
| 4,078,885 | 8/1978 | Opitz et al. | 8/527 |

FOREIGN PATENT DOCUMENTS

| | | |
|---|---|---|
| 572191 | 3/1959 | Canada . |
| 1085256 | 9/1967 | United Kingdom . |

*Primary Examiner*—A. Lionel Clingman

*Attorney, Agent, or Firm*—Curtis, Morris & Safford

[57] ABSTRACT

A process for the dyeing of textiles consisting totally or partially of synthetic polyamide fibers with reactive dyes according to the batchwise exhauston method, which comprises dyeing with aqueous dye liquors containing one or several reactive dyes, whose starting pH values are in the slightly acid to neutral range, in the high temperature range at 105° to 140° C. without the addition of alkalis or alkali-yielding agents and without the addition of acids or acid-yielding agents.

4 Claims, No Drawings

PROCESS FOR THE DYEING OF SYNTHETIC POLYAMIDE FIBERS WITH REACTIVE DYES ACCORDING TO THE BATCHWISE EXHAUSTION METHOD

This is a continuation of application Ser. No. 64,775 filed Aug. 8, 1979 abandoned Mar. 2, 1981.

The present invention relates to a process for the dyeing of synthetic polyamide fibers with reactive dyes according to the batchwise exhaustion method.

The present invention provides a process for the dyeing of textiles of synthetic polyamide fibers and/or of the polyamide fiber portion of mixtures with cellulose fibers according to the batchwise exhaustion method with reactive dyes.

The dyeing of polyamide fibers with reactive dyes has indeed already been described in the journal "Chemiefasern" 1965, pages 450 to 451 and 525 to 526, as well as in the pattern card S 8122/"®Remazol-Farbstoffe auf Nylon-®Helanca-Gewirk" of January, 1963, of Farbwerke Hoechst Aktiengesellschaft. According to said publications the reactive dye is at first converted into its reactive form by the action of alkalis, especially trisodium phosphate, and is then dyed onto the fiber material with the addition of acid, i.e., like an acid dye, at boiling temperature (95° to 100° C.) in accordance with the batchwise exhaustion method. This means that the process concerned is basically a two-stage process comprising both an alkaline and an acid dyeing stage. Since in this mode of operation the dyestuffs act as acid dyes regarding their affinity, there is the known risk of varying affinity as a consequence of irregularities (drawing differences) in the structure of synthetic polyamide fibers. This undesirable result is all the more aggravating, as the functional terminal amino groups of the polyamide fiber form a covalent bond with the dyestuffs, which reduces the migration capacity of the dyestuffs on the fiber, thus making impossible a levelling-up of dyeings once rendered uneven due to the source of errors mentioned above. As a counter-measure there are recommended the common levelling auxiliaries, which are applied in practice and which help to control the absorption process in a regular manner. 45 minutes to one hour is a typical dyeing period for this conventional method. This implies that a reduction of this long dyeing period would be desirable.

In the publication of Messrs. ICI "Technische Information" D 1406 there has also been described the dyeing of textile materials of polyamide fiber/cellulose fiber mixtures with reactive dyes, wherein the cotton component is at first dyed at a temperature below boiling temperature as well as under alkaline conditions, and subsequently the polyamide fiber portion of the textile goods is dyed in the exhausted cotton dye with the boiling liquor in the acid medium. This known two-stage process, which requires a dyeing period of 2 to 3 hours, may also be carried out in reverse order. In order to improve the fastness properties, a subsequent alkaline soaping is required in either case.

It has therefore been the underlying objective of the present invention to improve the known dyeing processes for synthetic polyamide fibers with reactive dyes, to develop a one-stage process, if possible, and to avoid the drawbacks of the former operations, such as levelling difficulties and long dyeing periods together with a change of the pH value of the bath. Naturally it is to be ensured that the dyestuff forms a covalent reactive bond with the fiber, so that the high fastness level of dyeings prepared with reactive dyes in common manner is reached.

This task is solved according to the invention by dyeing with aqueous dye liquors containing one or several reactive dyes, whose starting pH values are in the slightly acid to neutral range, in the high temperatue range at a temperature of from 105° to 140° C. without the addition of alkalis or alkali-yielding agents and without the addition of acids or acid-yielding agents.

When dyeing in accordance with the novel process, the dye liquors are completely exhausted within 5 to 30 minutes, preferably within 10 to 20 minutes, so that a good dyestuff utilization is ensured.

In order to carry out the process of the invention, the reactive dye and/or the reactive dye mixture is dissolved in water in common manner and added to the dye liquor at about 80° to 90° C. A preliminary activation of the reactive dye by way of alkalis as in the known process according to "Chemiefasern" (loc. cit.) does not take place in this cae. The pH value of these liquors (measured at 20° C.) is to be in the slightly acid to neutral range. This means that pH values of from about 4.0 to 7.0, preferably from 6.0 to 7.0, should be maintained. A pH adjustment is not required in most cases, as aqueous solutions of reactive dyes (in a commercial form and quality) are slightly acid per se. Process waters which have been softened with cation exchangers are frequently slightly alkaline and therefore require a pH correction to the above-mentioned range, suitably with acetic acid. Optional additives, such as wetting agents or electrolytes, are introduced into the dye bath prior to the dyestuff.

Immediately upon introducing the polyamide goods, which have in no way been subjected to a preliminary treatment with the addition of alkalis or alkali-yielding agents, the dye liquor is heated to dyeing temperature as rapidly as possible, and the dyeing is effected at a temperature of from 105° to 140° C., preferably from 120° to 130° C., within 5 to 30 minutes, preferably from 10 to 20 minutes. It is also possible to heat the dyeing goods, with the liquor possibly containing only a wetting agent and/or electrolyte to the dyeing temperature and thereafter to add the dissolved dyestuff to this bath. In this variant of the process, the dyeing period at the dyeing temperature is also in the range of from 5 to 30 minutes.

The present invention may also be considered for the one-bath dyeing of mixtures of synthetic polyamide fibers and cellulose fibers, wherein the advantages of the novel application technique for the reactive dyes become particularly evident. In such cases the dye liquors being employed contain additionally at least a neutral electrolyte. Generally, from 50 to 80 g/l of sodium chloride or sodium sulfate are added for this purpose to the solutions of the reactive dyes. Within the framework of this variant, the reactive dyes are absorbed by both the polyamide component and the cellulose portion of the fiber mixture, which generally takes place practically simultaneously.

For carrying out the novel process all dyeing apparatuses and/or dyeing machines which permit a high temperature treatment of the dyeing goods are suitable. Thus, synthetic polyamide fibers may practically by dyed in all processing stages. There have not been encountered any difficulties with regard to material of varying affinity.

As compared with the known conventional methods for the dyeing of synthetic polyamide fibers by way of the batchwise exhaustion method, the process of the invention is distinguished by its simplicity and by a considerable reduction of the dyeing periods. The fastness properties which may be obtained correspond in all tests to those of dyeings which have been prepared according to the twostage processes common so far. Surprisingly, it has even been observed that dyeings of this kind stand up to a reductive aftertreatment which is usually only applied in the dyeing with disperse dyes, by which fact the excellent fastness of the said dyeings is demonstrated. In compliance with the characteristic feature of the invention, an aftertreatment of the dyeings produced according to the invention following the high temperature dyeing operation with the addition of alkalis or alkali-yielding agents as well as with the addition of acids or acid-yielding agents is not necessary. In most cases the goods need only to be rinsed with water of 60° to 70° C. and with cold water.

For the dyeing of synthetic polyamide fibers and/or of mixtures of polyamide and cellulose fibers according to the present invention the reactive dyes considered are the organic dyestuffs known by this term, independently of the nature of their rective groups. This class of dyestuffs is termed "Reactive Dyes" in Colour Index, 3rd edition, 1971. The dyestuffs concerned are predominantly those which contain at least one group which is able to react with polyhydroxyl fibers or the amino groups of polyamide fibers, a precursor of the same, or a substituent that can be reacted with the polyhydroxyl fiber or the amino groups of polyamide fibers. As basic substances of the organic dyestuffs, there are especially suitable those of the series of azo, anthraquinone and phthalocyanine dyestuffs, the azo and phthalocyanine dyestuffs optionally being free from metal or containing metal. As reactive groups and precursors forming these reactive groups there may be mentioned as examples epoxy groups, the ethylene imide group, the vinyl grouping in the vinylsulfone or acrylic acid radicals, the $\beta$-sulfatoethylsulfone group, the $\beta$-chloroethylsulfone group or the $\beta$-dialkylamine-ethylsulfone group. Also suitable are derivatives of the tetrafluorocyclobutyl series, for example tetrafluorocyclobutylacrylic acid. As reactive substituents in reactive dyes there may be used those which can easily be split off and leave an electrophilic radical. As substituents there may be mentioned, for example, from 1 to 3 halogen atoms at the following ring systems: Quinoxaline, triazine, pyrimidine, phthalazine, pyridazine and pyridazone. Use may also be made of dyestuffs having several homogeneous or heterogeneous reactive groups.

The following Examples serve to illustrate the invention.

EXAMPLE 1

On a high temperature beam dyeing apparatus, a knitted fabric of polyamide-6,6 fibers is treated, at a goods-to-liquor ratio of 1:20, with an aqueous liquor which contains—calculated on the weight of the dry goods—

2% of the dyestuff Reactive Blue 19 having the C.I. No. 61 200

(in a commercial form and quality).

The dyestuff is dissolved in water, and this solution is added to the dye liquor of 80° C., whose pH value is 6.3 without the dyestuff addition. Immediately upon introducing the dyeing goods into the bath, the temperature of the liquor is rapidly increased to 130° C. and the goods are then dyed for 15 minutes at 130° C. Thereafter the liquor is cooled and the dyeing produced is rinsed with water until it becomes clear.

A deep clear blue dyeing of the knitted fabric is obtained which shows very good fastness properties.

If the dyeing thus produced is subjected to an aftertreatment for 10 minutes at 70° C. with an aqueous bath, while adding 0.5 g/l of the reaction product of 1 mol of nonyl phenol and 8 mols of ethylene oxide, there is obtained in addition an excellent fastness to wet processing.

EXAMPLES 2 to 5

The dyeings are effected as has been described in Example 1, except that goods-to-liquor ratio of 1:15 is used, and the dyeing periods given below are observed:

(2)

1.4% of the reactive dye of the formula

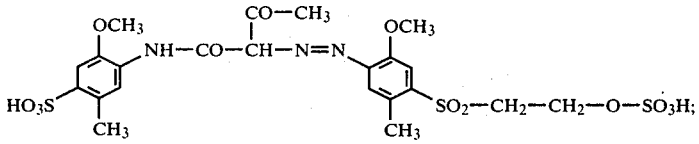

dyeing period 20 minutes;

clear yellow dyeing with favorable fastness properties;

(3)

8% of the dyestuff Reactive Black 5 having the C.I. No. 20,505;

dyeing period 25 minutes;

black dyeing of the knitted fabric with favorable fastness properties;

(4)

1.23% of the dyestuff Reactive Orange 16 having the C.I. No. 17,757;

dyeing period 10 minutes;

scarlet dyeing of the knitted fabric with favorable fastness properties;

(5)

1% of the reactive dye of the formula

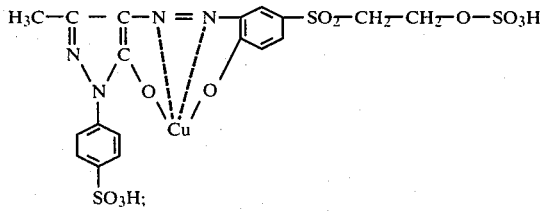

dyeing period 20 minutes;

dull yellow dyeing with very good fastness properties.

EXAMPLES 6 AND 7

The dyeings are effected as has been described in Example 1, except that a goods-to-liquor ratio of 1:12 is used, and in both cases a porous knitted fabric of polyamide-6 fibers is used:

(6)

1.3% of the reactive dye of the formula;

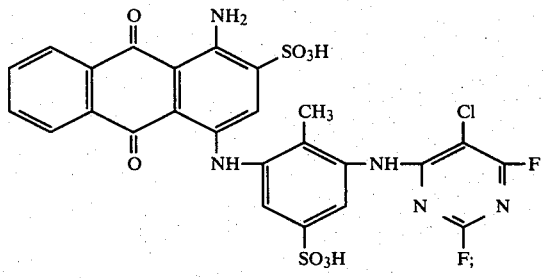

clear blue dyeing of the knitted fabric;

(7)

1.3% of the reactive dye of the formula

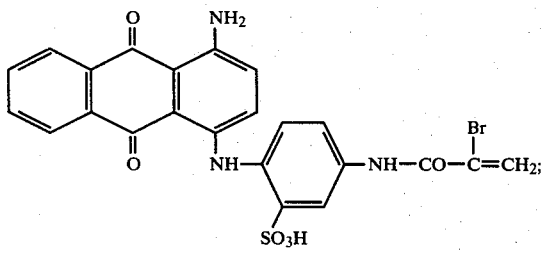

blue dyeing similar to that in Example 6.

EXAMPLE 8

According to the directions given in Example 1, an elastic knitted fabric of polyurethane fibers covered with polyamide-6 filaments is dyed, at a goods-to-liquor ratio of 1:12, with an aqueous liquor which contains, calculated on the weight of the dry goods, 0.4% of the reactive dye of the formula

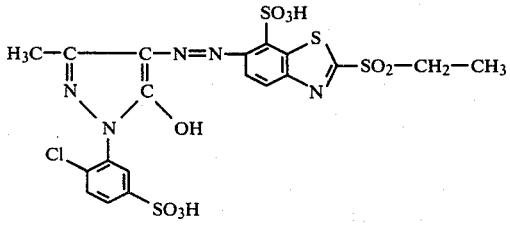

(in a commercial form and quality). The dyeing period is 10 minutes. A yellow dyeing of the polyamide cover is obtained.

EXAMPLE 9

Cross-wound bobbins of polyamide-6 continuous filaments are dyed, at a goods-to-liquor ratio of 1:10, with an aqueous liquor which contains—calculated on the weight of the dry goods—0.84% of the reactive dye of the formula

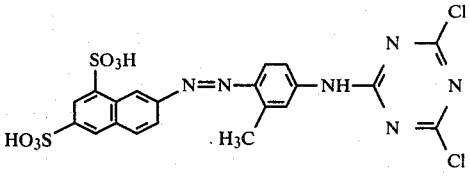

(in a commercial form and quality). The dyestuff is dissolved with hot water, and this solution is added to the dye bath at 70° C. containing the textile goods. The liquor is then heated to 125° C. as rapidly as possible, and the goods are dyes for 8 minutes at this temperature. After the cooling of the bath and following the rinsing of the bobbins with water, a yellow dyeing of the polyamide filaments is obtained.

EXAMPLE 10

On a high temperature jet apparatus a mixed fabric of 50% of synthetic polyamide fibers and 50% of cotton is dyed, at a goods-to-liquor ratio of 1:18, according to the specifications given in Example 1, with an aqueous liquor which contains—calculated on the weight of the dry goods—

2% of the reactive dye of the formula

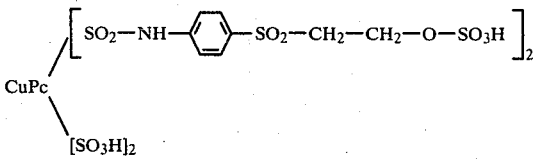

(CuPc = copper phthalocyanine)

(in a commercial form and quality), as well as an addition of 60 g/l of Glauber's salt calc. The dyeing period is 20 minutes in this case.

An even turquoise dyeing of the fabric with good fastness properties is obtained on both fiber components.

What is claimed is:

1. In a process for the dyeing of a textile consisting of or containing synthetic polyamide fibers, with reactive dyes according to the batchwise exhaustion method, the improvement which comprises contacting the textile with an aqueous dye liquor containing one or more water-soluble reactive dyes, the initial pH value of said dye liquor being in the slightly acid to neutral range, for a time of from 5 to 30 minutes while maintaining the temperature of said liquor in the range of from 105° to 140° C., without the addition of an alkali or alkali-yielding agent and without the addition of an acid or acid-yielding agent.

2. A process as defined in claim 1, which comprises contacting said textile and dye liquor for a time of from 10 to 20 minutes while maintaining the temperature of said liquor in the range of from 120° to 130° C.

3. A process as defined in claim 1, which comprises dyeing a mixture of synthetic polyamide and cellulose fibers in a one-stage, one-bath operation, the dye liquor containing a neutral electrolyte.

4. A process as defined in claim 1 or 3, which further comprises aftertreating of the dyed textile, following the dyeing operation, without the addition of an alkali or alkali-yielding agent and without the addition of an acid or acid-yielding agent.

* * * * *